United States Patent [19]

Hauber

[11] Patent Number: 4,895,398

[45] Date of Patent: Jan. 23, 1990

[54] LATCH FOR SLIDING CLOSURES

[76] Inventor: Peter Hauber, 9001 N. Glenoaks, Sun Valley, Calif. 91352

[21] Appl. No.: 227,997

[22] Filed: Aug. 3, 1988

Related U.S. Application Data

[63] Continuation of Ser. No. 940,522, Dec. 10, 1986, abandoned.

[51] Int. Cl.[4] ..... E05C 3/06

[52] U.S. Cl. ..... 292/83; 292/85; 292/98; 292/124; 292/126; 292/197; 292/226

[58] Field of Search ..... 292/121, 124, 126, 129, 292/83, 98, 197, 224, 229, 100, 27, 65, 85, 182, 111, 132; 70/95, 100

[56] References Cited

U.S. PATENT DOCUMENTS

| | | | |
|---|---|---|---|
| 251,367 | 12/1881 | King | 292/98 |
| 1,424,936 | 8/1922 | Pearson | 292/124 |
| 1,489,965 | 4/1924 | Prentice | 292/98 X |
| 3,275,361 | 9/1966 | Riegelmon | 292/129 |
| 4,185,479 | 1/1980 | Riegelman | 292/182 X |
| 4,502,715 | 3/1985 | Lundblade | 292/100 X |

FOREIGN PATENT DOCUMENTS

| | | | |
|---|---|---|---|
| 654888 | 1/1938 | Fed. Rep. of Germany | 292/124 |

*Primary Examiner*—Gary L. Smith
*Assistant Examiner*—Eric K. Nicholson
*Attorney, Agent, or Firm*—Louis J. Bachand

[57] ABSTRACT

A latch especially adapted for sliding closures is provided comprising a rocker 36 having a hooked terminus 46, and means to deflect said rocker into engagement with a latch keeper 30, comprising a housing 12 having a slot 28 about which the rocker 36 rocks, and rocker rocking means comprising a biasing spring 34 and an oppositely acting pivot 38 having first and second shoulders 42, 43 in offset relation for rocking the rocker into keeper 30 engagement upon pivot rotation, the shoulders 42, 43 being locally relieved at 52 to permit return movement of the rocker 36 out of keeper engagement responsive to reverse pivot 38 rotation.

18 Claims, 1 Drawing Sheet

FIG. 1
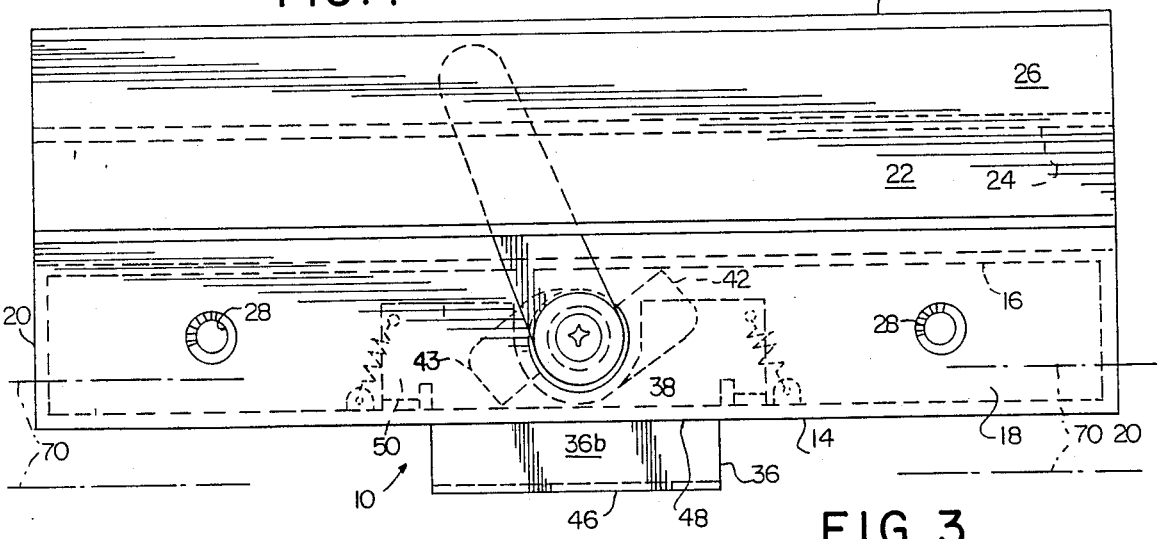
FIG. 2
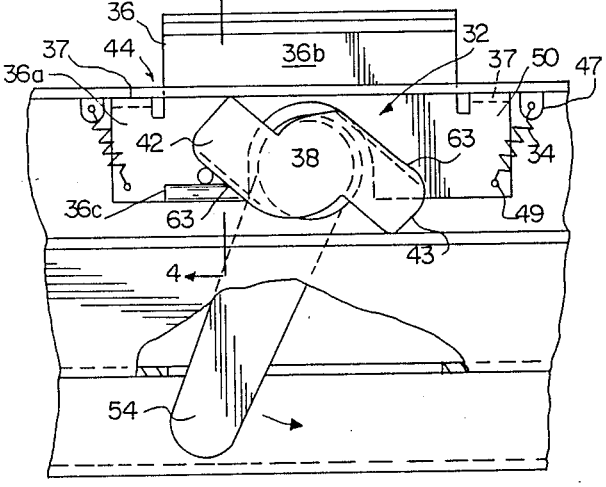
FIG. 3
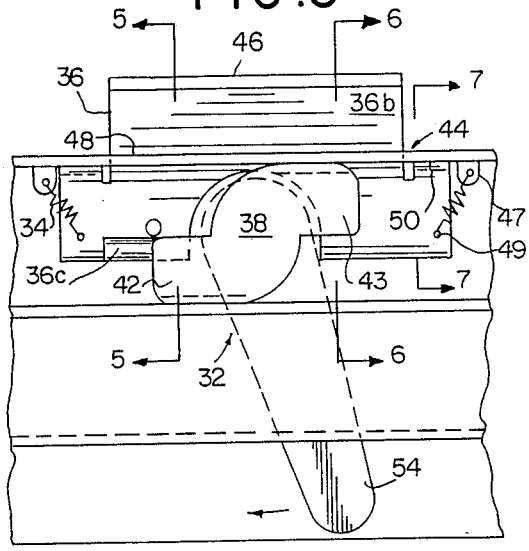
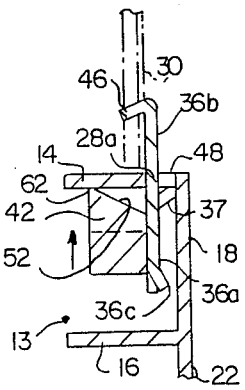
FIG. 4
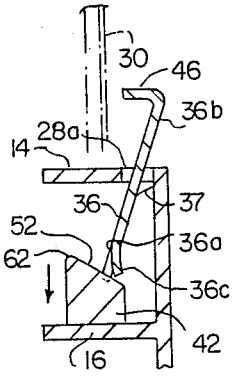
FIG. 5
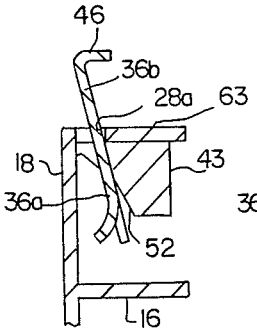
FIG. 6
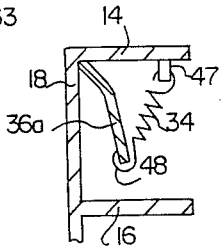
FIG. 7

LATCH FOR SLIDING CLOSURES

This application is a continuation of application Ser. No. 940,522, filed Dec. 10, 1986, now abandoned.

This invention has to do with fasteners for locking sliding closures such as patio doors and metal frame windows. More particularly, the invention is concerned with latches for sliding closures which are economical to produce, simple in assembly and operation, positive in locking action and secure against intrusion.

BACKGROUND OF THE INVENTION

Latches for sliding closures have taken many forms from pivoting hooks which engage a pin, to elaborate cammed devices which move eccentrically into pin engagement against ready dislodgement. Requirements of strength and low cost are ever present and demand better latch designs than those presently available.

SUMMARY OF THE INVENTION

It is an object of the invention to provide a sliding closure latch which better meets the needs of the current marketplace. It is another object to provide a sliding closure latch which moves laterally into its keeper against easy dislodgement, and for strength with minimum material usage. A still further object is to provide a sliding closure latch which has a minimum number of moving parts, is positive in action and securely latches by a simple pivoting movement of a latch actuator translated into a lateral movement of the latch element. Yet another object is to provide a latch for sliding closures in which the latch element is bodily movable within its housing against the resilient urging of a biasing spring and pivotable at the housing front wall by a pivot means having opposed and offset shoulders contoured to deflect the latch into or out of keeper engaging position responsive to rotation of the pivot means on an axis normal to the plane of the latch.

SUMMARY OF THE INVENTION

These and other objects of the invention to become apparent hereinafter are achieved in a latch for locking sliding closures, comprising a housing adapted to be mounted on the stile of a sliding closure opposite an opposing jamb-mounted laterally enterable latch keeper, the housing having a front wall defining a slot; a latch having an inner portion mounted in the housing and an outer portion registerable with the latch keeper beyond the housing, the latch being hinged at the slot in outer latch portion lateral movement effecting relation for selectively entering the latch keeper; and housing-supported pivot means for hingedly deflecting the latch to enter the keeper, the pivot means having an axis of rotation and first and second shoulders on opposite sides of the axis, the shoulders being laterally offset to effect the latch deflection in a first rotated position of the pivot means and oppositely relieved to accommodate the undeflected condition of the latch in a second rotated position of the pivot means.

In more particular embodiments, the housing is generally rectangular, and has a side wall extending the length of the front wall, the pivot means being journaled in the side wall; the latch is a flat, generally rectangular plate of a predetermined longitudinal extent, the plate front corners being notched to define the latch outer portion relative to the latch inner portion; the latch outer portion has a terminal flange for latching to the keeper; the latch inner portion defines front edge upsets opposite the housing front wall against passage of the inner latch portion through the slot; there is further included spring means urging the latch into its undeflected condition by resiliently engaging the latch inner portion with the housing front wall in bodily shiftable relation, the spring means cooperating with the housing to define the hinged relation of the latch to the housing; the latch is a flat, generally rectangular plate of predetermined transverse extent less than the transverse width of the housing, at least one of the pivot means shoulders being sized and shaped to fit between the latch inner portion and the rear wall of the housing in the plane of the latch portion; the latch inner portion is upset opposite the shoulder in the plane of the latch portion to define a camming cooperating surface on the latch portion for the shoulder relief; and the housing defines a lateral extension, and there is further included a pull mounted on the extension, and a latch actuator adjacent the pull, the actuator comprising a lever for rotating the pivot means in latch deflection determining relation.

In another embodiment the invention provides a latch for locking sliding closures, comprising a housing adapted to be mounted on the stile of a sliding closure opposite an opposing jamb-mounted laterally enterable latch keeper, the housing having a front wall defining a slot; a bodily shiftable latch having an inner portion disposed in the housing and an outer portion registerable with the latch keeper beyond the housing, the latch being pivotable at the slot in outer latch portion lateral movement effecting relation for selectively entering the latch keeper; and housing-supported pivot means for pivotally deflecting the latch to enter the keeper, the pivot means having an axis of rotation and first and second shoulders on opposite sides of the axis, the shoulders being laterally offset to effect the latch deflection in a first rotated position of the pivot means and oppositely relieved to accommodate the undeflected condition of the latch in a second rotated position of the pivot means.

In this and like embodiments it may be further provided that the housing is generally rectangular, and has a side wall extending along the front wall, the pivot means being journaled in the side wall; the latch is a flat, generally rectangular plate of a predetermined longitudinal extent, the plate front corners being notched to define the latch outer portion relative to the latch inner portion; the latch outer portion has a terminal flange for latching to the keeper; the latch inner portion includes means blocking passage of the inner latch portion through the slot; the latch is a flat, generally rectangular plate of predetermined transverse extent less than the transverse width of the housing, at least one of the pivot means shoulders being sized and shaped to fit between the latch inner portion and the rear wall of the housing in the plane of the latch portion in the undeflected condition of the latch; the latch inner portion defines a camming cooperating surface opposite the shoulder relief; and the housing defines a lateral extension, and including also a pull mounted on the extension, and a latch actuator adjacent the pull, the actuator comprising a lever for rotating the pivot means in latch deflection determining relation, whereby with the latch plate in the undeflected condition with its outer portion terminal flange opposite the latch keeper, one the pivot means shoulder cams across the latch plate to deflect the latch plate to the deflected condition, and the other the shoulder cooperates with the one shoulder to lock the latch plate in the deflected condition with the latch outer portion flange deflected into and engaged with the keeper.

In yet another embodiment, there is provided latch for sliding closures comprising a rocker having a hooked terminus, and means to deflect the rocker terminus into engagement with a latch keeper, the means comprising a housing having a slot about which the rocker rocks, and rocker rocking means comprising a biasing spring and an oppositely acting pivot having first and second shoulders in offset relation for rocking the rocker into keeper engagement upon pivot rotation, the shoulders being locally relieved to permit return movement of the rocker out of keeper engagement responsive to reverse pivot rotation.

THE DRAWING

The invention will be further described as to an illustrative embodiment in conjunction with the attached drawings in which:

FIG. 1 is a side elevational view of the latch according to the invention;

FIG. 2 is a reverse side elevational view thereof, the latch being shown in latch keeper engaging position;

FIG. 3 is a reverse view like FIG. 2, the latch being shown in unlatched position;

FIG. 4 is a view taken on line 4—4 in FIG. 2;

FIG. 5 is a view taken on line 5—5 in FIG. 3;

FIG. 6 is a view taken on line 6—6 in FIG. 3; and,

FIG. 7 is a view taken on line 7—7 in FIG. 3.

PREFERRED MODES

The present latch is adapted for locking sliding doors and windows of the type having a sliding panel incorporating a stile which abuts a door jamb. The jamb is typically provided with a keeper, or like means for retaining the latch tongue. In the present invention, movement of the latch tongue is lateral, such that the keeper is open to receive the latch tongue and defines a means for engaging the latch tongue upon lateral movement of the tongue, i.e. generally normal to the plane of the keeper.

With reference now to the FIGS. 1–7 in detail, the latch for sliding closures according to the invention is shown generally at 10, and will be seen to comprise a housing 12 which is generally rectangular in longitudinal and transverse cross-section (FIGS. 4–7) and has a side opening 13 formed by a front wall 14, a rear wall 16 spaced from the front wall, and a side wall 18. End caps 20 close the opposite ends of the housing 12. Rear wall 16 has a rearwardly extending skirt 22 which is deflected at 24 to form a pull 26 in the conventional manner of extruded door handle-latch combinations. A pair of screw holes 28 are provided for screw-mounting the housing 12 to a door stile (not shown) in registering relation with the keeper 30 mounted to the door jamb.

The latch 10 further comprises the latch mechanism 32 positioned centrally of the housing and supported therein by a pair of biasing springs 34. The latch mechanism 32 comprises a latch plate 36 and a pivot 38 having shoulders 42, 43 which bear on the latch plate as shown.

The latch plate 36, formed from a rigid metal stamping, is generally flat and rectangular with an inner rectangular portion **36*a* having upsets 37 abutting the back of front wall 14, and an outer rectangular portion 36*b* of lesser transverse extent, defined from the inner portions by corner notching at 44 on the plate 36. The outer plate portion 36*b* defines the latch tongue and has a somewhat hook-shaped terminal flange 46 formed as an upset on the outer portion 36*b* at less than about 90° to the outer portion plane. The biasing springs 34 are secured to the housing front wall 14 at tabs 47 and extend to apertures 49 formed in the latch plate inner portion 36*a* in a manner to yieldingly support the plate 36 within the housing 12. The housing front wall 14 defines a slot 48 through which the plate outer portion 36*b* projects as the latch tongue. The plate shoulders 50, formed by the corner notching of the plate at 44 as described, serve to block movement of the plate 36 through the slot 48, as shown, against the pressure of the biasing springs 34. There is no other support of the latch plate 36 in the housing 12 other than as just identified: the springs 34 and the slot 48-shoulders 50 interference, so that the plate floats within the housing under the spring constraint, a feature which enables the latch to absorb inadvertent axial impacts, such as are encountered when the door is closed against an immovable object, without breaking. Yet the latch plate 36 in its locked mode is rigid in its resistance to an opening pull by virtue of the shoulders 50 butting against the back of front wall 14 portions surrounding the slot 48**.

The latch plate 36 is actuated between its latching and unlatching conditions by the uniquely configured pivot 38. The pivot 38 extends through the housing side wall 16 wherein it may be journaled for easy rotation. A latch handle lever 54 is secured to the outer end of the pivot 38 outside the housing 12 for moving the pivot angularly. The inner end of the pivot 38 terminates in the transverse shoulders 42, 43. As best shown in FIGS. 2 and 3, rotation of the pivot 38 moves shoulders 42, 43 angularly. With reference to FIGS. 2–6, this rotation brings differently shaped portions of the shoulders 42, 43 into contact with the plate inner portion **36*a*. The pivot shoulders 42, 43 are opposed in offset relation across the pivot 38. The faces of the shoulders 42, 43 are sloped as shown to define camming surfaces 52 opposite the inner plate portion 36*a*. The sizing of the shoulders 42, 43 relative to the plate inner portion 36*a* and the surrounding housing 12 is such that in one rotated condition of the pivot 38, the plate 36 is free of deflection by the shoulders 42, 43, whereas in a second relatively rotated condition, the shoulders 42, 43 are both engaged with the plate deflecting it and locking it in position. To do this, the shoulders 42, 43 are relieved in a plane at an angle to the plane of rotational movement, as shown. In the FIG. 3, 5 and 6 undeflected (unlatched) condition of the plate 36, the pivot shoulder 42 is positioned between the plate portion 36*a* and the rear wall 18 of the housing 12. The rearward edge of the plate 36 may be upset at 36*c* to further accommodate this positioning, as shown. Such upset 36*c* cooperates with the plate facing sloped surface 52 on shoulder 42 to facilitate reversing the rotation of the pivot. In the FIG. 3 position the pivot shoulder 43 butts with the housing front wall 14, and its sloped face relieved opposite the plate 36 to form surface 52 accommodates the angular disposition of the plate induced by the urging of the biasing springs 34, as best seen in FIG. 6**.

In the FIGS. 2 and 4 deflected condition of the plate 36, the pivot shoulders 42, 43 have been rotated by the pivot 38 to bear against the plate with their ridges 62, 63 respectively, whereby the plate is deflected from its angular disposition to a disposition normal to the pivot, as shown. In this position, the plate 36 is locked in place against pulling movement, as previously described, but is still yieldable to a frontal impact since the ridges 62, 63 have but frictional engagement with the plate 36, one which allows the plate to slide beneath them, but which blocks all manner of translational movement toward the pivot shoulders 42, 43. In this manner, the present latch affords the very desirable characteristics of positive locking, but yieldability against breaking force from an inadvertent axial impact.

The plate 36 latches by having its terminal flange 46 laterally enter a cooperating keeper, shown in phantom in FIGS. 4–5. The plate 36 movement necessary for this lateral entry is one of rocking or pivoting, as by a hinge, of the plate about a fulcrum defined by the edge 28*a* of slot 28 formed in the front wall 14 of the housing 12. As best shown in FIGS. 4–6, the plate 36 pivots about the slot edge 28*a*, although not necessarily in contact with that edge. That is the slot 28 defines a locus of pivoting for the plate 36, bounded for example by dashed lines designated 70 in FIG. 1 of the drawing, and the actual axis of rocking or hinging will be determined by the spring 34 effects and the pivoting shoulders 42, 43 effects in positioning the plate within the slot 28. Accordingly, the terms "pivot", "hinge" and "rock" all refer to movement of the plate 36 about an axis within the plate and parallel to the axis of the slot 28 and within the 70 locus defined by the slot.

We claim:

1. Latch for locking sliding closures, comprising: a housing adapted to be mounted on the stile of a sliding closure opposite an opposing jamb-mounted laterally enterable latch keeper, said housing having a front wall defing a slot; a latch having an inner portion within said housing and an outer portion registerable with said latch keeper beyond said housing, said latch being pivoted at said slot for selectively entering said latch keeper; and pivot means for deflecting said latch to enter said keeper, said pivot means being rotatably fixed to said housing about an axis of rotation and having laterally offset, oppositely facing, oppositely sloped first and second shoulders on opposite sides of said axis in a manner to have said shoulders cooperatively simultaneously engage said latch portion within said housing in deflecting relation when rotated in a first direction and to not deflectingly engage said latch portion when oppositely rotated, whereby said latch is supported by two shoulders when latched and yet is pivotable away from latching without interference from said shoulders.

2. Latch according to claim 1, in which said housing is generally rectangular, and has a side wall extending the length of said front wall, said pivot means being journaled in said side wall.

3. Latch according to claim 1, in which said latch is a flat, generally rectangular plate of a predetermined longitudinal extent, said plate front corners being notched to define said latch outer portion relative to said latch inner portion.

4. Latch according to claim 1, in which said latch outer portion has a terminal flange for latching to said keeper.

5. Latch according to claim 1, in which said latch inner portion defines front edge upsets opposite said housing front wall against passage of said inner latch portion through said slot.

6. Latch according to claim 1, including also spring means urging said latch into unlatched condition by resiliently engaging said latch inner portion with said housing front wall in bodily shiftable relation, said spring means cooperating with said housing to define the hinged relation of said latch to said housing.

7. Latch according to claim 1, in which said housing is generally rectangular, said latch is a flat, generally rectangular plate of predetermined transverse extent less than the transverse width of said housing, at least one of said pivot means shoulders being sized and shaped and mounted to fit between said latch inner portion and the rear wall of said housing in the plane of said latch portion.

8. Latch according to claim 7, in which said latch inner portion is upset opposite said shoulder in the plane of said latch portion to define a camming cooperating surface on said latch portion for said shoulder.

9. Latch according to claim 1, in which said housing defines a lateral extension, and including also a pull mounted on said extension, and a latch actuator adjacent said pull, said actuator comprising a lever for rotating said pivot means to deflect said latch deflection.

10. Latch for locking sliding closures, comprising a housing adapted to be mounted on the stile of a sliding closure opposite an opposing jamb-mounted laterally enterable latch keeper, said housing having a front wall defining a slot; a bodily shiftable latch having an inner portion disposed in said housing and an outer portion registerable with said latch keeper beyond said housing, said latch being pivotable at said slot about a first axis of rotation parallel with said slot for outer latch portion lateral movement to enter said latch keeper; and housing-supported pivot means for pivotally deflecting said latch to enter said keeper, said pivot means having an second axis of rotation and first and second oppositely facing shoulders on opposite sides of said second axis of rotation in laterally offset relation, whereby upon rotation in a first direction each shoulder simultaneously engages said latch for deflection into said keeper in a first rotated position of said pivot means, said shoulders being shaped to accommodate the undeflected condition of said latch in a second rotated position of said pivot means.

11. Latch according to claim 10, in which said housing is generally rectangular, and has a side wall extending along said front wall, said pivot means being journaled in said side wall.

12. Latch according to claim 11, in which said latch is a flat, generally rectangular plate of a predetermined longitudinal extent, said plate front corners being notched to define said latch outer portion relative to said latch inner portion.

13. Latch according to claim 12, in which said latch outer portion has a terminal flange for latching to said keeper.

14. Latch according to claim 10, including also spring means mounting said latch to said housing wall.

15. Latch according to claim 14, in which said housing is generally rectangular, said latch is a flat, generally rectangular plate of predetermined transverse extent less than the transverse width of said housing, at least one of said pivot means shoulders being sized and shaped to fit between said latch inner portion and the rear wall of said housing in the plane of said latch portion in the undeflected condition of said latch.

16. Latch according to claim 15, in which said latch inner portion defines a camming cooperating surface opposite said shoulder.

17. Latch according to claim 16, in which said housing defines a lateral extension, and including also a pull mounted on said extension, and a latch actuator adjacent said pull, said actuator comprising a lever for rotating said pivot means to determine latch deflection, whereby with said latch plate in the undeflected condition with its outer portion terminal flange opposite said latch keeper, one said pivot means shoulder cams across said latch plate to deflect said latch plate to said deflected condition, and the other said latch plate in the deflected condition with the latch outer portion flange deflected into and engaged with said keeper.

18. Latch for sliding closures comprising a rocker having a hooked terminus, and means to deflect said rocker into engagement with a latch keeper, said means comprising a housing having a slot about which said rocker rocks, and rocker rocking means comprising a biasing spring and an oppositely acting pivot having first and second shoulders in offset relation for both simultaneously rocking said rocker into keeper engagement upon pivot rotation, said shoulders being shaped to permit return movement of said rocker out of keeper engagement responsive to reverse pivot rotation.

* * * * *